US010634349B2

(12) United States Patent
Kidder et al.

(10) Patent No.: US 10,634,349 B2
(45) Date of Patent: Apr. 28, 2020

(54) WEAR PAD SYSTEM FOR TURBINE COMBUSTION SYSTEMS AND METHOD FOR COUPLING WEAR PAD INTO TURBINE COMBUSTION SYSTEM

(71) Applicant: General Electric Company, Schenectady, NY (US)

(72) Inventors: Kyle Lee Kidder, Greenville, SC (US); Tiffany Marie Craig, Simpsonville, SC (US); Eunice Delia Garza, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 981 days.

(21) Appl. No.: 14/833,388

(22) Filed: Aug. 24, 2015

(65) Prior Publication Data

US 2017/0059158 A1 Mar. 2, 2017

(51) Int. Cl.
*F23R 3/60* (2006.01)
*F23R 3/00* (2006.01)
(Continued)

(52) U.S. Cl.
CPC ..... *F23R 3/002* (2013.01); *B23P 15/00* (2013.01); *F01D 9/023* (2013.01); *F23R 3/46* (2013.01);
(Continued)

(58) Field of Classification Search
CPC .. F01D 9/023; F23R 3/60; F23R 2900/00012; F23R 2900/00017; F23R 3/002; F16L 39/005
(Continued)

(56) References Cited

U.S. PATENT DOCUMENTS 1,356,574 A 10/1920 Warder
2,017,994 A * 10/1935 Spang ..... F16L 17/035 285/105
(Continued)

FOREIGN PATENT DOCUMENTS

CN 203738063 U 7/2014
DE 19529268 A1 4/1997
(Continued)

OTHER PUBLICATIONS

U.S. Appl. No. 14/833,396, filed Aug. 24, 2015, Final Office Action dated Oct. 25, 2017, 32 pages.
(Continued)

*Primary Examiner* — William H Rodriguez
*Assistant Examiner* — Thomas P Burke
(74) *Attorney, Agent, or Firm* — James Pemrick; Hoffman Warnick LLC

(57) ABSTRACT

An aspect of the invention provides for a wear pad system for a turbine combustion system including a transition piece (TP) forward ring, an impingement sleeve substantially surrounding the TP forward ring, and a gap between the TP forward ring and the impingement sleeve, the wear pad system comprising: a wear pad extending through a hole in the impingement sleeve and through the gap to contact the TP forward ring, the wear pad having a radially outer portion and a radially inner portion, the radially outer portion in contact with a radially outer surface of the impingement sleeve and the radially inner portion in contact with a radially outer surface of the TP forward ring.

18 Claims, 10 Drawing Sheets

(51) Int. Cl.
*F01D 9/02* (2006.01)
*F23R 3/46* (2006.01)
*B23P 15/00* (2006.01)

(52) U.S. Cl.
CPC ..... *F23R 3/60* (2013.01); *B23P 2700/13* (2013.01); *F23R 2900/00012* (2013.01); *F23R 2900/00017* (2013.01); *F23R 2900/03044* (2013.01)

(58) Field of Classification Search
USPC ..... 285/123.1, 123.3–123.14
See application file for complete search history.

(56) References Cited

U.S. PATENT DOCUMENTS

| | | | | |
|---|---|---|---|---|
| 2,353,757 | A | 7/1944 | Priest, Jr. | |
| 3,743,433 | A | 7/1973 | Smith | |
| 4,748,806 | A * | 6/1988 | Drobny | F02K 1/80 60/800 |
| 5,333,443 | A * | 8/1994 | Halila | F23R 3/002 60/752 |
| 7,207,603 | B2 * | 4/2007 | Segreto | F16L 59/18 285/123.3 |
| 2003/0123953 | A1 * | 7/2003 | Razzell | F01D 25/243 411/419 |
| 2003/0160447 | A1 * | 8/2003 | Stark | F16L 9/19 285/123.1 |
| 2010/0263386 | A1 * | 10/2010 | Edwards | F23R 3/002 60/796 |
| 2012/0029143 | A1 | 2/2012 | Sepeur et al. | |
| 2012/0269592 | A1 | 10/2012 | Holmes et al. | |
| 2012/0291437 | A1 | 11/2012 | Moehrie et al. | |
| 2013/0213047 | A1 * | 8/2013 | Desai | F23R 3/002 60/752 |
| 2014/0238031 | A1 * | 8/2014 | Okita | F23R 3/06 60/754 |
| 2015/0283660 | A1 | 10/2015 | Cassidy et al. | |
| 2017/0159483 | A1 * | 6/2017 | Hudson | F01D 11/22 |

FOREIGN PATENT DOCUMENTS

| | | | |
|---|---|---|---|
| EP | 1 847 685 | A2 | 10/2007 |
| EP | 2 489 938 | A2 | 8/2012 |
| WO | 98/16764 | A1 | 4/1998 |

OTHER PUBLICATIONS

Extended European Search Report and Opinion issued in connection with corresponding EP Application No. 16185122.5 dated Jan. 31, 2017.

U.S. Appl. No. 14/833,396, Office Action 1 dated Jun. 2, 2017, 15 pages.

European Search Report dated Jun. 19, 2017 for EP Application No. 16185124.1; pp. 8.

* cited by examiner

WEAR PAD SYSTEM FOR TURBINE COMBUSTION SYSTEMS AND METHOD FOR COUPLING WEAR PAD INTO TURBINE COMBUSTION SYSTEM

BACKGROUND OF THE INVENTION

The disclosure relates generally to power generation systems, and more particularly, to a power generation system including a wear pad system for turbine combustion systems and a method for coupling a wear pad into a turbine combustion system.

Power generation systems, including gas turbines are widely used. A conventional gas turbine system typically includes, inter alia, a compressor, a combustor, a turbine section, and a transition piece for connecting the flow of the combustor to the turbine section. During operation of the turbine, components experience vibrations which may result in structural wear to those components and/or the turbine itself. In the transition piece of the turbine, wear pads or spacers have been employed to prevent components of the transition piece from becoming worn due to vibrations. For example, wear pads are used in the transition piece between the transition piece (TP) forward ring and the impingement sleeve which surrounds the TP forward ring. While these wear pads are generally successful in preventing wear caused by vibration, it is expensive and difficult to maintain and replace them.

Generally, replacing the wear pads between impingement sleeves and TP forward rings requires disassembling the transition piece and the combustor in order to remove the worn wear pads and insert new wear pads. Impingement sleeves have been manufactured such that impingement sleeves include two or more parts to allow for disassembly of the impingement sleeve when replacing wear pads.

BRIEF DESCRIPTION OF THE INVENTION

A first aspect of the invention provides for a wear pad system for a turbine combustion system including a transition piece (TP) forward ring, an impingement sleeve substantially surrounding the TP forward ring, and a gap between the TP forward ring and the impingement sleeve, the wear pad system comprising: a wear pad extending through a hole in the impingement sleeve and through the gap to contact the TP forward ring, the wear pad having a radially outer portion and a radially inner portion, the radially outer portion in contact with a radially outer surface of the impingement sleeve and the radially inner portion in contact with a radially outer surface of the TP forward ring.

A second aspect of the invention provides for a wear pad system for a turbine combustion system including a transition piece (TP) forward ring, and impingement sleeve substantially surrounding the TP forward ring, and a gap between the TP forward ring and the impingement sleeve, the wear pad system comprising: a wear pad having a radially inner portion and a radially outer portion, the wear pad positioned within the gap such that the radially outer portion of the wear pad contacts a radially outer portion of the TP forward ring.

A third aspect of the invention provides for a method for coupling a wear pad into a turbine combustion system including a transition piece (TP) forward ring, and impingement sleeve substantially surrounding the TP forward ring, and a gap between the TP forward ring and the impingement sleeve, the method comprising: installing the wear pad between the impingement sleeve and the TP forward ring; joining the wear pad to the impingement sleeve; installing a retaining element circumferentially about the impingement sleeve, the retaining element placing tension on the impingement sleeve such that the gap is closed between a radially inner surface the impingement sleeve and a radially outer surface of the TP forward ring at a location of the wear pad.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In drawings, like numbering represents like elements between the drawings.

DETAILED DESCRIPTION OF THE INVENTION

As indicated above, the disclosure provides for a wear pad system for turbine combustion systems and a method for coupling a wear pad into a turbine combustion system.

Figure 1:
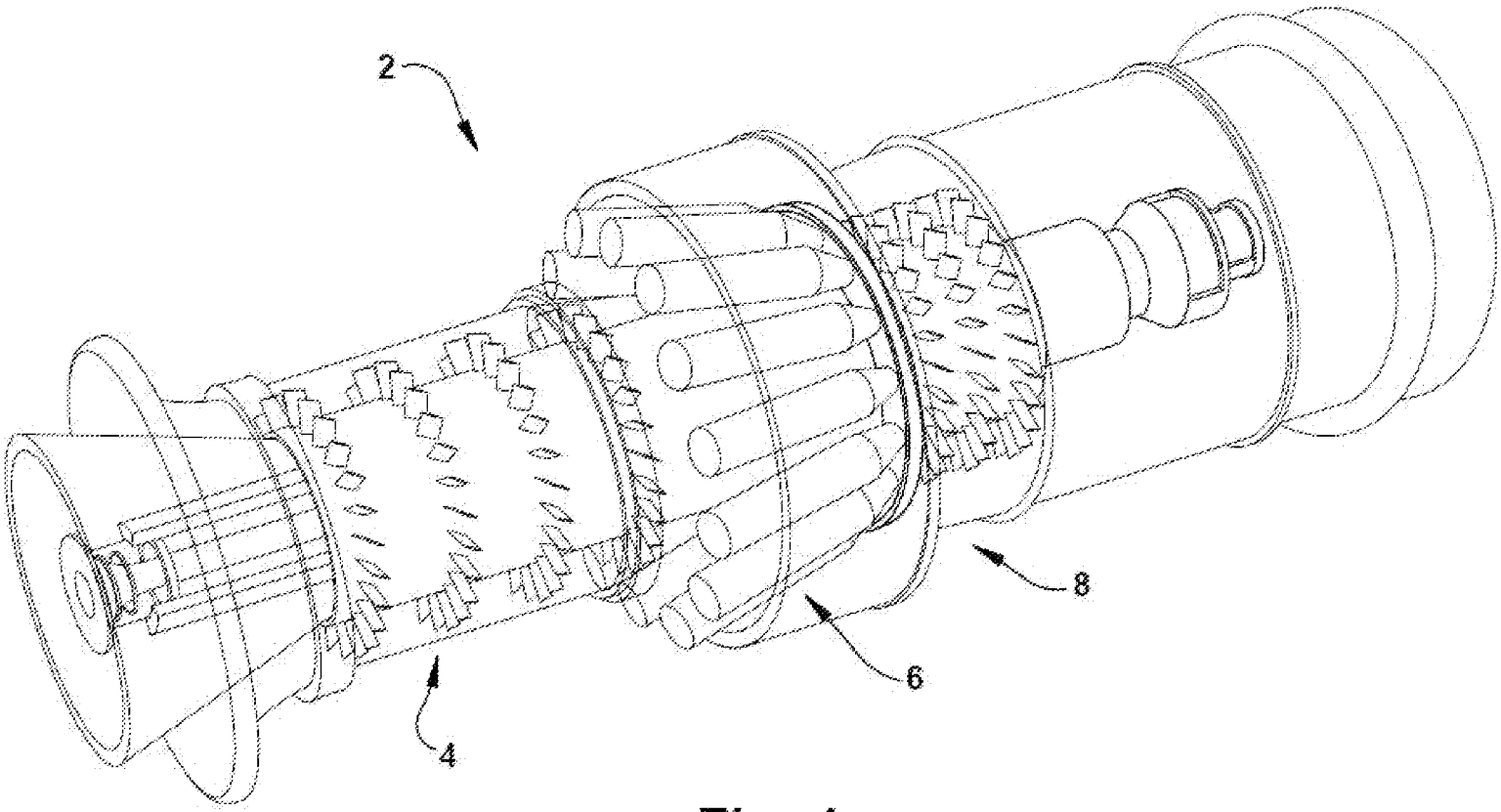
Fig. 1 (Prior Art)
FIG. 1 shows a conventional turbine system.

Referring to FIG. 1, a conventional gas turbine 2 is shown. Gas turbine 2 includes a compressor 4, a set of combustors 6, and a turbine section 8. Compressor 4 may include a multi-stage axial flow compressor having a rotating shaft. Air enters an inlet of the compressor 4 and is compressed by the compressor blade stages and then is discharged to a combustor 6 where fuel, such as natural gas, is introduced via nozzles. Fuel is burned to provide a high energy combustion gas flow to drive a turbine section 8. In turbine section 8, the energy of the hot gases is converted into work, some of which may be used to drive integral compressor 6 through a rotating shaft, with the remainder available for useful work to drive a load such as a generator via a rotating shaft (e.g., an extension of the rotating shaft) for producing electricity.

Figure 2:
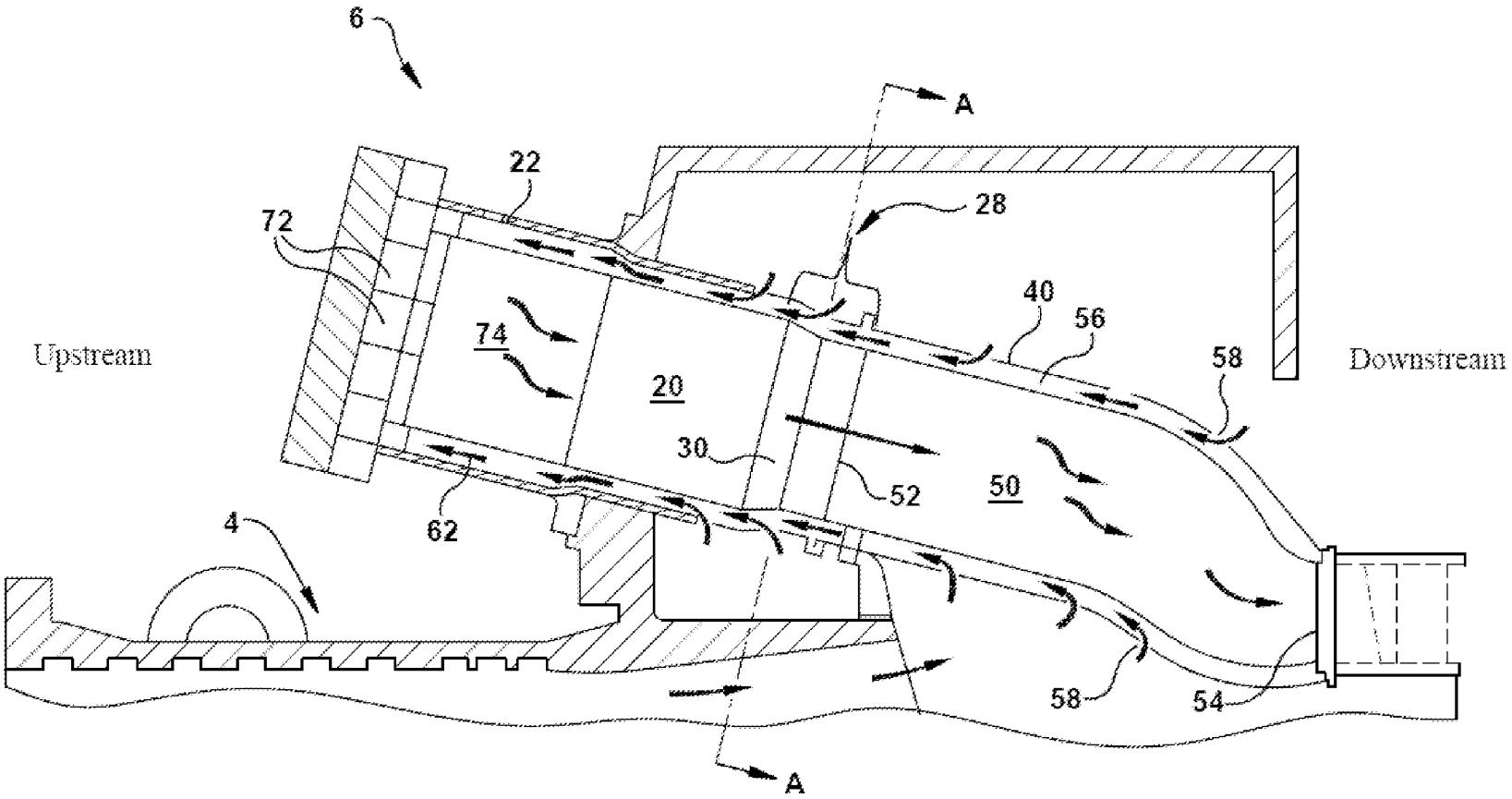
Fig. 2 (Prior Art)
FIG. 2 shows a plan view of a cross-section of a combustor from the turbine system of FIG. 1.
Figure 4:
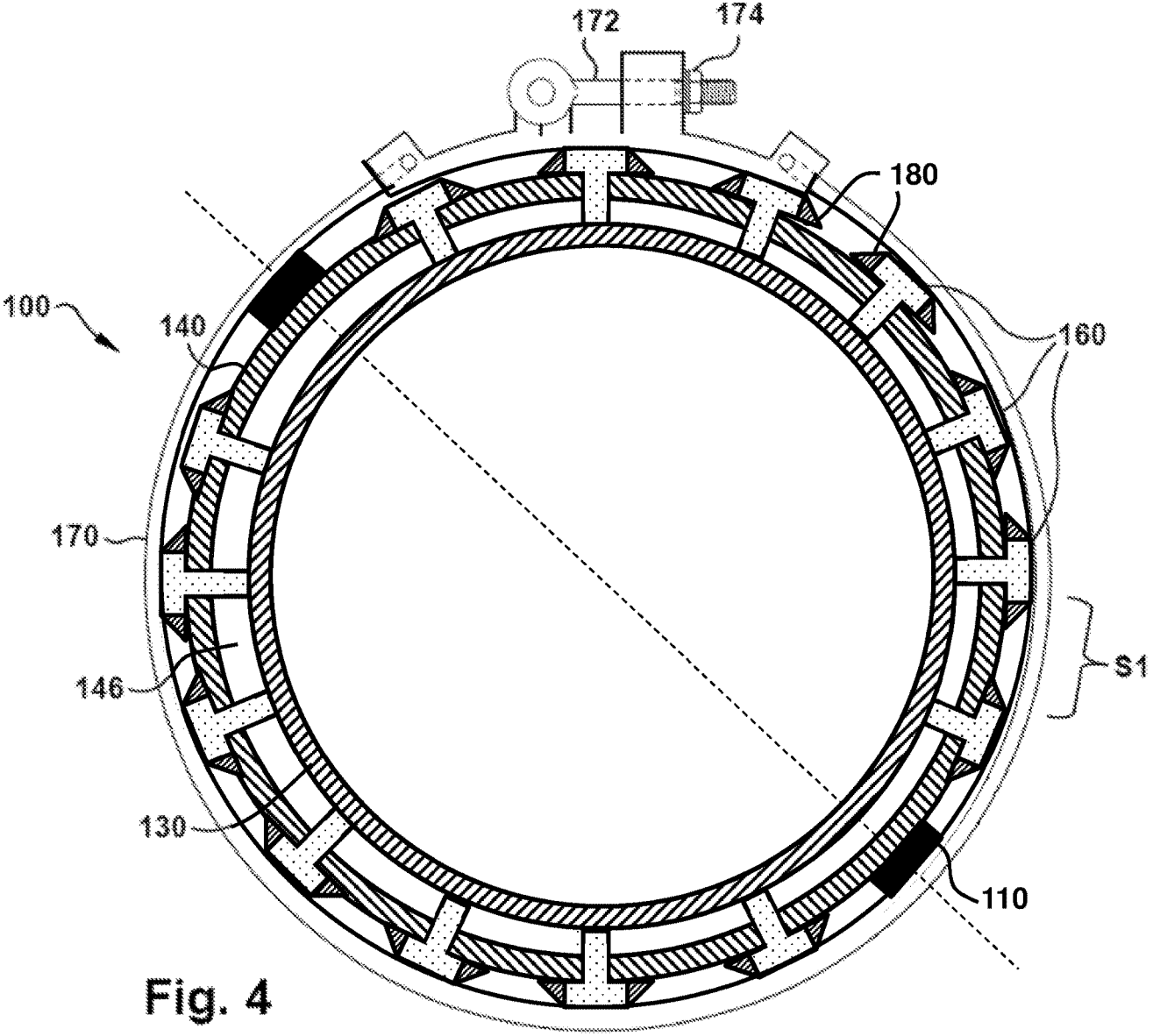
FIG. 4 shows a circumferential view of the embodiment shown in FIG. 3.
Figure 7:
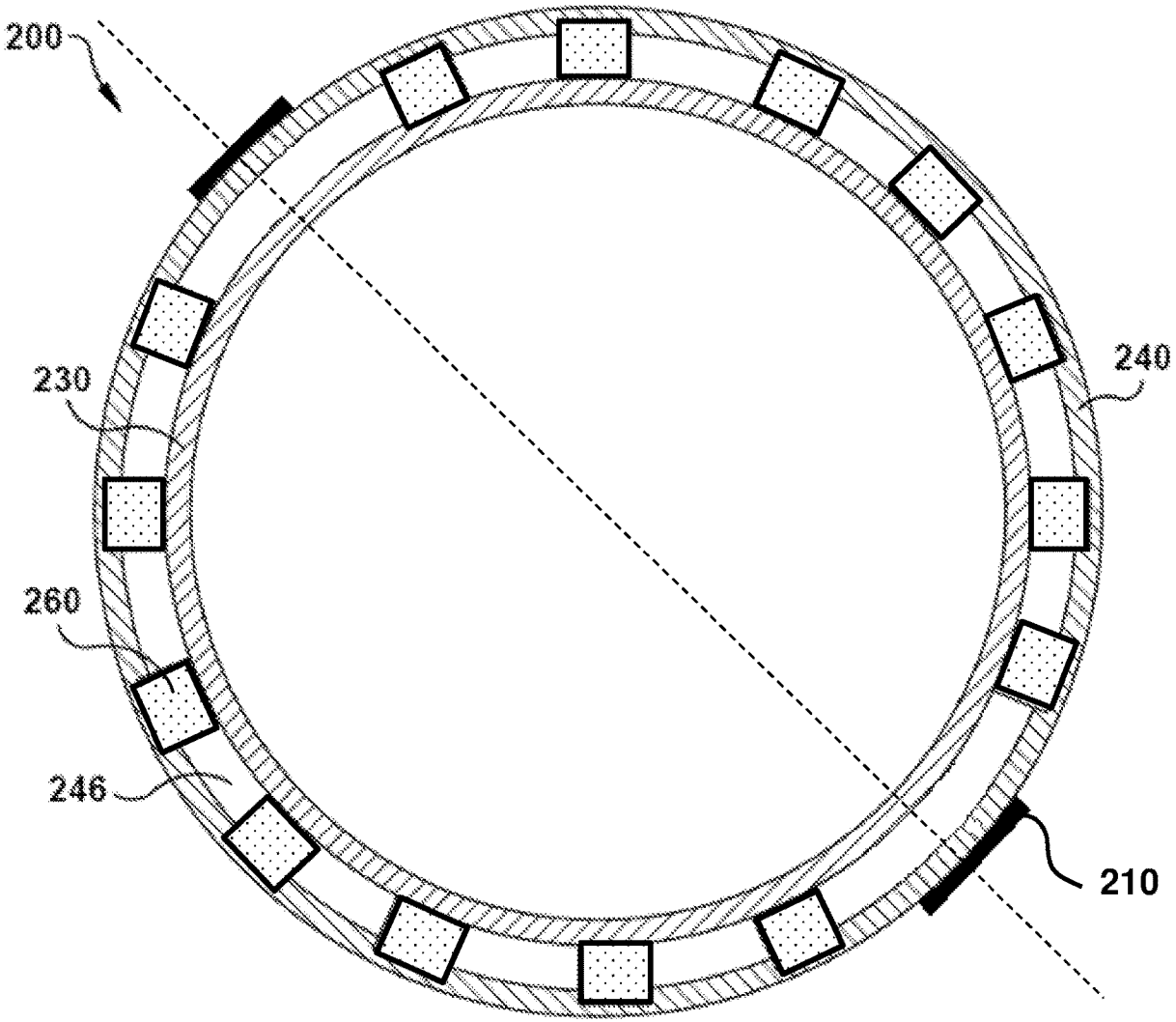
FIG. 7 shows a circumferential view of the embodiment shown in FIG. 6.

Referring now to FIG. 2, which shows a cross-section of combustor 6 of gas turbine 2, each combustor 6 may include a combustion chamber 20, a transition piece 28 having a transition piece (TP) forward ring, an impingement sleeve 40, and a duct 50. Duct 50 may include an upstream end 52 and a downstream end 54. Upstream end 52 of duct 50 may be of a substantially circular shape and downstream end 54 of duct 50 may be of a substantially rectangular shape. As such herein, "substantially" refers to largely, for the most part, entirely specified or any slight deviation which provides the same technical benefits of the invention. Upstream end 52 of duct 50 may be fluidly connected to combustion chamber 20. Downstream end 54 of duct 50 may be fluidly connected to turbine section 8 (FIG. 1). Duct 50 may be substantially surrounded by impingement sleeve 40 such that a flow path 56 is formed therebetween. Impingement sleeve 40 may include a plurality of inlets 58 which provide the working fluid/air 62 from compressor 4 to combustor 6 via flow path 56 between impingement sleeve 40 and duct 50. As known in the art, impingement sleeves generally consist of two arcuate halves or segments (shown by dotted lines in FIGS. 4 and 7) which are connected via seal plates or buckles 110, 210 (FIGS. 4 and 7).

Combustion chamber 20 may include a combustion liner 22 which surrounds and encases combustion chamber 20. Combustion liner 22 also forms flow path 56 between combustion liner 22 and combustion chamber 20. As working fluid/air 62 travels up flow path 56 into combustion chamber 20 it combines with fuel supplied by nozzles 72 in combustor 6 and is ignited to supply a fuel/air mixture 74 to duct 50. Fuel/air mixture 74 exits combustor 6 at downstream end 54 of duct 50 to turbine section 8 (FIG. 1).

Transition piece 28 may connect combustion chamber 20 and duct 50. Transition piece 28 may include a TP forward ring 30 which may slidably engage within impingement sleeve 40 as is known in the art. That is, impingement sleeve 40 may substantially surround TP forward ring 30. The concentric arrangement of impingement sleeve 40 and TP forward ring 30 provides a gap, the gap facilitates the placement of wear pads or spacers therein to prevent TP forward ring 30 and impingement sleeve 40 from vibrating and damaging each other during operation of turbine 2 (FIG. 1). Over time these wear pads or spacers become worn and no longer serve to protect the components as originally intended. As such, wear pads are typically replaced to maintain separation of TP forward ring 30 and impingement sleeve 40. However, current wear pad systems and methods of replacing wear pads are timely and expensive because they require disassembly of the component parts. For example, current methods for replacement of wear pads involve removing or uninstalling buckles or seal plates from impingement sleeve 40 such that the two halves of impingement sleeve 40 may be separated and the wear pads and TP forward ring 30 thereunder can be accessed. This allows worn wear pads to be removed and/or new wear pads to be installed. Once wear pads are replaced, the two halves of impingement sleeve 40 are repositioned, surrounding the wear pads and TP forward ring 30, and welded or otherwise connected together. Subsequently, seal plates or buckles are reattached to maintain the two halves of impingement sleeve 40 together.

Aspects of the present invention provide for a wear pad system for a turbine combustion system and method for coupling a wear pad into a turbine combustion system in which the disassembly of the transition piece and/or impingement sleeve is not required. Aspects of the present invention include providing a wear pad through a hole in the impingement sleeve and providing a wear pad via an upstream end of the impingement sleeve. The present invention thus decreases time and costs associated with the conventional systems and methods of replacing wear pads. Additionally, aspects of the present invention allow for a reduction in the number of components of impingement sleeves because the impingement sleeves employing the present invention do not require disassembly, i.e. detachment of the two halves of the impingement sleeve.

Figure 3:
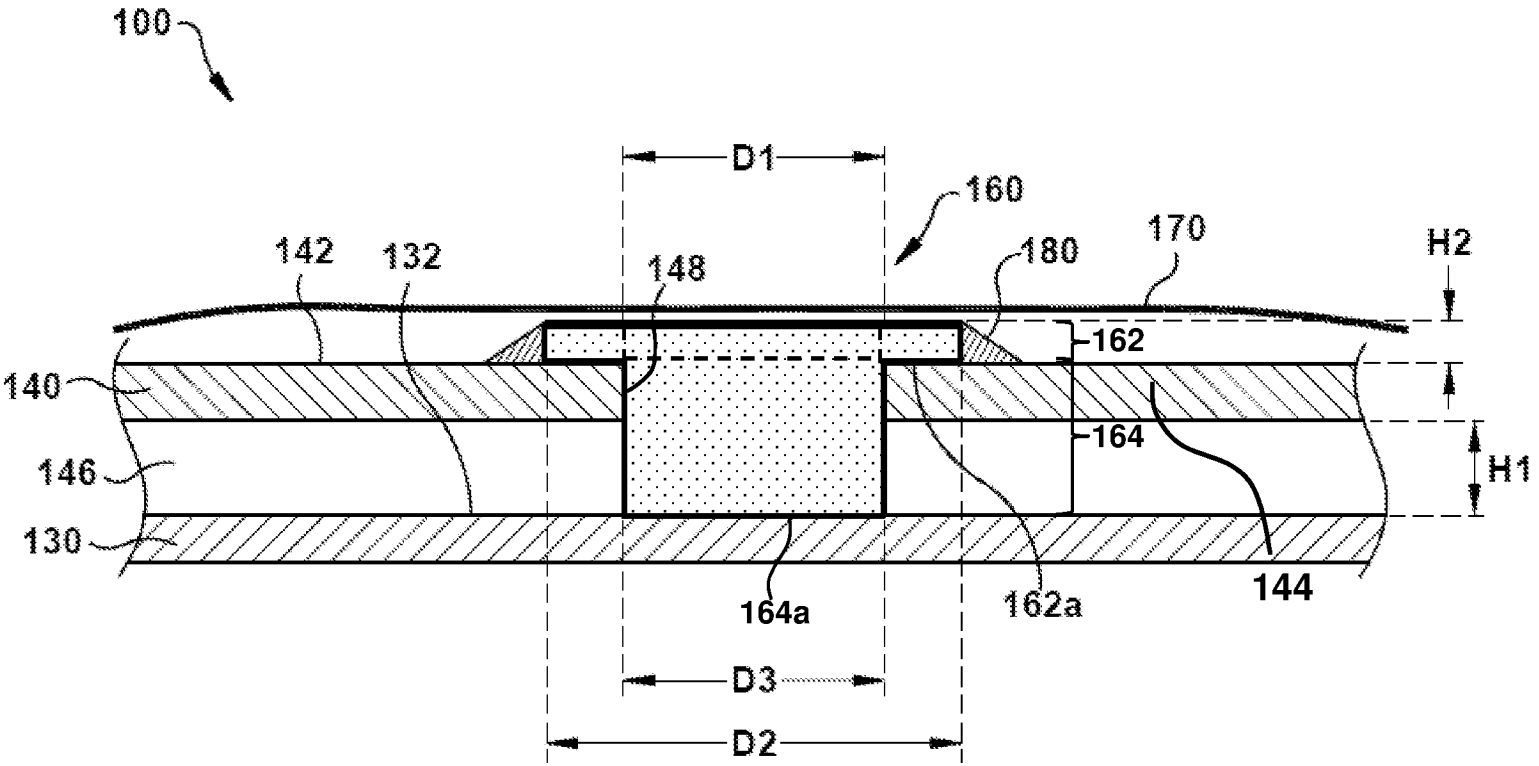
FIG. 3 shows a plan view of a cross-section of the wear pad system according to one embodiment of the invention employed at line A-A of FIG. 2.

FIGS. 3-4 show a wear pad system 100 for a turbine combustion system according to an embodiment of the present invention. FIG. 3 shows a plan view of a cross-section of wear pad system 100 employed at line A-A of FIG. 2. FIG. 4 shows a circumferential view of the embodiment shown in FIG. 3. As previously described, turbine combustion system may include a transition piece (TP) forward ring 130, an impingement sleeve 140 substantially surrounding TP forward ring 130, and a gap 146 between TP forward ring 130 and impingement sleeve 140. Wear pad system 100 may include a wear pad 160 extending through gap 146 to contact both TP forward ring 130 and impingement sleeve 140.

In one embodiment, wear pad 160 may be a wear resistant pin having a substantially "T-shaped" cross-section as shown in FIGS. 3-4. Wear pad 160 may include a radially outer portion 162 and a radially inner portion 164 (FIG. 3). In this embodiment, radially inner portion 164 may extend from a radially outer surface 132 of TP forward ring 130 through gap 146 to radially outer surface 142 of impingement sleeve 140. That is, radially inner portion 164 of wear pad 160 may extend through a hole 148 in impingement sleeve 140 and through gap 146 such that a radially inner surface 164*a* of radially inner portion 164 of wear pad 160 contacts a radially outer surface 132 of TP forward ring 130. Additionally, a radially inner surface 162*a* of radially outer portion 162 of wear pad 160 may contact a radially outer surface 142 of impingement sleeve 140. As previously discussed, wear pad 160 may be a wear resistant pin therefore inner portion 164 and outer portion 164 of wear pad 160 may each be substantially cylindrical in shape. Radially outer portion 162 of wear pad 160 may have a diameter D2 that is greater than a diameter D3 of radially inner portion 164. For example, radially outer portion 162 may have a diameter D2 substantially equal to approximately 0.500 centimeters (cm) to approximately 1.000 cm and radially inner portion 164 may have a diameter D3 substantially equal to approximately 0.250 cm to approximately 0.750 cm. Diameter D3 of radially inner portion 164 may be determined by diameter D1 of hole 148. That is, diameter D3 of radially inner portion 164 may be such that radially inner portion 164 may fit snuggly within hole 148. Additionally, radially inner portion 164 of wear pad 160 may have a height H1 that is greater than a height H2 of radially outer portion 162 of wear pad 160. For example, radially inner portion 164 may have a height H1 substantially equal to approximately of 0.500 cm to approximately 0.800 cm and radially outer portion 162 may have a height H2 substantially equal to approximately 0.100 cm to approximately 0.400 cm. As used herein "approximately" is intended to include values, for example, within 10% of the stated values. In other embodiments, wear pad 160 may be substantially "T-shaped" having similar dimensions. Wear pad 160 may include any wear-resistant material such as a nickel based alloy or other high performance alloy including but not limited to HAYNES® alloy 25 (L605). Hole 148 in impingement sleeve 140 may provide access to gap 146 between impingement sleeve 140 and TP forward ring 130. Hole 148 may have a diameter D1 substantially equal to approximately 0.250 cm to approximately 0.750 cm (FIG. 3). Hole 148 may be provided by drilling into impingement sleeve 140 as will be described herein.

As shown in FIG. 4, wear pad system 100 may include a plurality of wear pads 160 spaced circumferentially about impingement sleeve 140. That is, impingement sleeve 140 may include a plurality of holes 148 (FIG. 3) spaced circumferentially about impingement sleeve 140 for accommodating a plurality of wear pads 160 such that each wear pad 160 extends through a respective hole 148 and through gap 146 to contact TP forward ring 130. It is to be understood that wear pad system 100 is not limited to the number of wear pads 160 shown in FIG. 4. Rather, any number of wear pads 160 may be included in wear pad system 100. Additionally, each wear pad 160 may vary in size (i.e., diameter of radially inner and outer portion of wear pad D2, D3 (FIG. 3)). Further, spacing (distance) S1 between wear pads 160 about the impingement sleeve 140 may vary without departing from aspects of the invention.

As shown best in FIG. 3, wear pad system 100 may also include a weld 180. Weld 180 may be used to join wear pad 160 to impingement sleeve 140. Weld 180 may include, but is not limited to carbon steel filler materials, stainless steel, copper, aluminum, nickel, tungsten, zirconium and alloys thereof. Weld 180 may be provided at an outer circumference of wear pad and radially outer surface 142 of impingement sleeve 140. In other embodiments, wear pad 160 may be joined to impingement sleeve 140 via brazing or press-fitting.

A retaining element 170 may be used to substantially surround impingement sleeve 140 to further secure wear pad 160 to impingement sleeve 140 during coupling wear pad 160 into turbine combustion system as will be described herein. Retaining element 170 may include, but is not limited to, a buckle, a clamp, a cable support, and a band, such as a belly band. FIG. 4 shows retaining element 170 as a belly band including a tightening clamp having an eye bolt 172 and a nut 174 to ensure a tight enclosure of wear pads 160 to impingement sleeve 140. That is, retaining element 170 may place tension on radially outer portion 162 (FIG. 3) of wear pad 160 thereby placing tension on impingement sleeve 140 such that that gap 146 is closed between radially inner surface 144 of impingement sleeve 140 and radially outer surface 132 of TP forward ring 130 by virtue of wear pad 160 therebetween. Where retaining element 170 is a belly band, belly band may be similar to a locking cable, and may be made of, for example, aluminum or steel. However, it is to be understood that any type of similar clamp or retaining device can be employed without departing from aspects of the invention.

Figure 5:
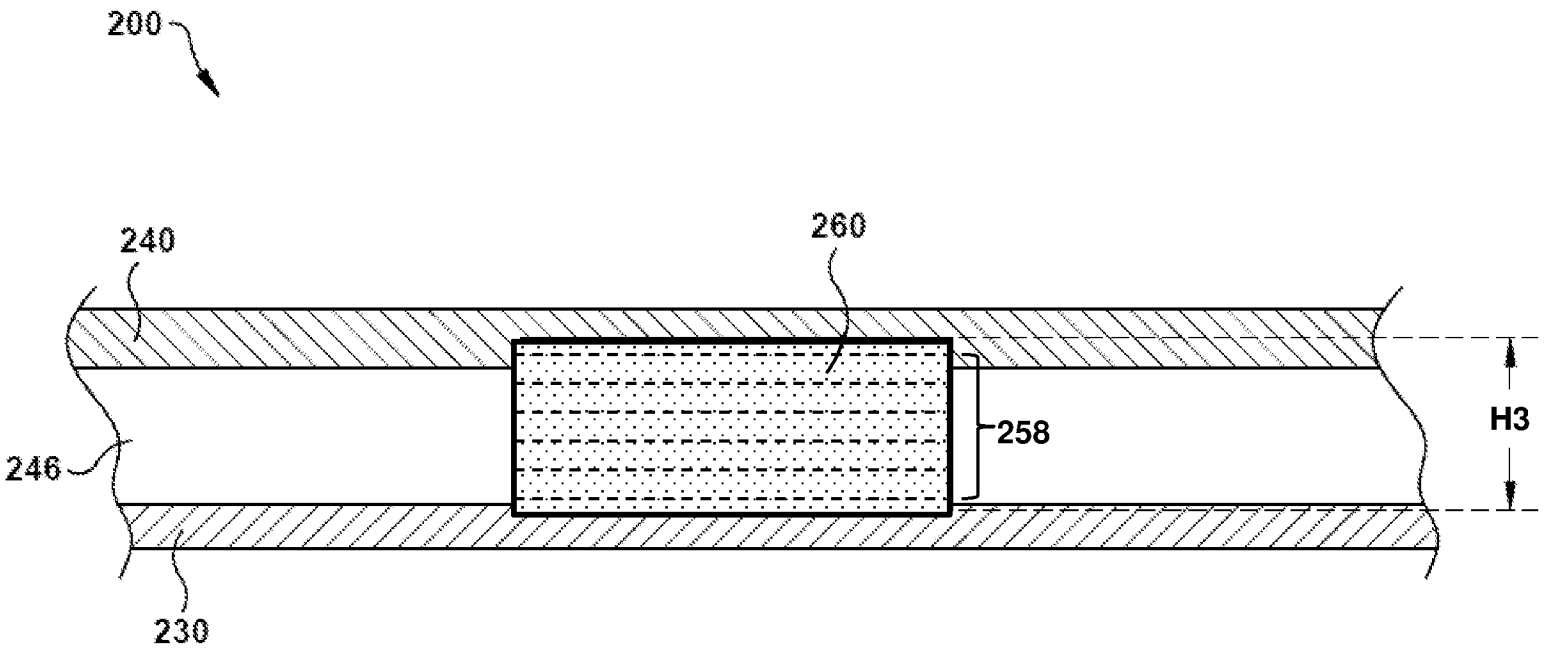
FIG. 5 shows a plan view of a cross-section of the wear pad system according to another embodiment of the invention employed at line A-A of FIG. 2.
Figure 6:
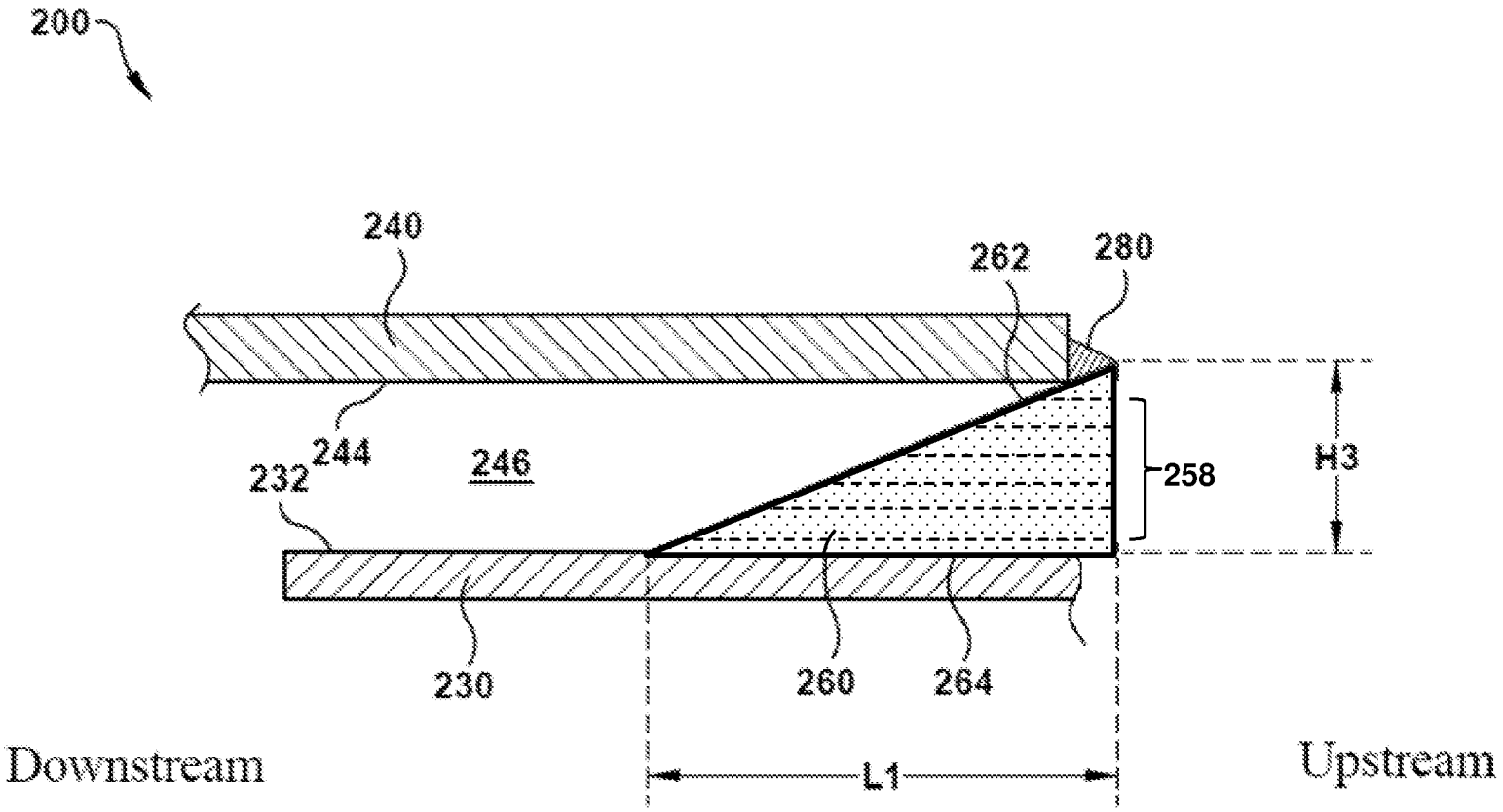
FIG. 6 shows a side view of the embodiment shown in FIG. 5.

FIGS. 5-7 show another embodiment of a wear pad system 200. FIG. 5 shows a plan view of a cross-section of wear pad system 200 employed at line A-A of FIG. 2. FIG. 6 shows a side view of the embodiment shown in FIG. 5. FIG. 7 shows a circumferential view of the embodiment shown in FIG. 5. Referring to FIGS. 5-7 together, and as discussed previously, turbine combustion system may include a transition piece (TP) forward ring 230, an impingement sleeve 240 substantially surrounding the TP forward ring 230, and a gap 246 between TP forward ring 230 and impingement sleeve 240. In this embodiment, wear pad system 200 may include a wear pad 260 that is inserted from an upstream direction positioned between TP forward ring 230 and impingement sleeve 240 in gap 246. Wear pad 260 may be shaped as a wear-resistant wedge. In some embodiments, wear pad 260 may include a multi-layer shim. As previously discussed, wear pad 260 may include any wear-resistant material such as a nickel based alloy or other high performance alloy including but not limited to HAYNES® alloy 25 (L605). Wear pad 260 may include a radially outer surface 262 and a radially inner surface 264 (FIG. 6). Radially outer surface 262 of wear pad 260 may contact a radially inner surface 244 of impingement sleeve 240 and radially inner surface 264 of wear pad 260 may contact a radially outer surface 232 of TP forward ring 230. Wear pad 260 may include a plurality of removable adhesive layers 258 as shown by dotted lines in FIGS. 5-6. Layers 258 facilitate the customization of wear pad 160, such that a dimension (i.e., length L1 and height H3) of wear pad 160 may be adjusted by adding or removing at least one layer. Wear pad 260 may have a height H3 substantially equal to approximately 0.500 cm to approximately 0.800 cm. Wear pad 260 may also have a length L1 substantially equal to approximately 0.500 cm to 1.000 cm. Additionally, wear pad system 200 may include a plurality of wear pads 260 spaced circumferentially about impingement sleeve 240 and TP forward ring 230 (FIG. 7). While FIG. 7 does not show dotted lines to indicate layers 258 in wear pads 260, it is to be understood that that the layers 258 have been removed for clarity but may be included.

Wear pad system 200 may also include a weld 280 (FIG. 6). Weld 280 may be used to join wear pad 260 to impingement sleeve 240. Weld 280 may include, but is not limited to a carbon steel filler material, stainless steel, copper, aluminum, nickel, tungsten, zirconium and alloys thereof. Weld 280 may be provided at radially outer surface 262 of wear pad 260 and an upstream end of impingement sleeve 240. In another embodiment, wear pad 260 may be brazed to impingement sleeve 240. In yet another embodiment, wear pad 260 could be press-fitted between impingement sleeve 240 and TP forward ring 230.

In this embodiment, a retaining element (not shown in FIGS. 5-7) may also be employed similar to that as shown in FIG. 4. However, in this embodiment, retaining element may be installed such that retaining element surrounds impingement sleeve 240 and may place tension on impingement sleeve 240 such that the gap 246 is closed between radially inner surface 244 of impingement sleeve 240 and radially outer surface 232 of TP forward ring 230 by virtue of wear pad 260 therebetween.

Figure 8:
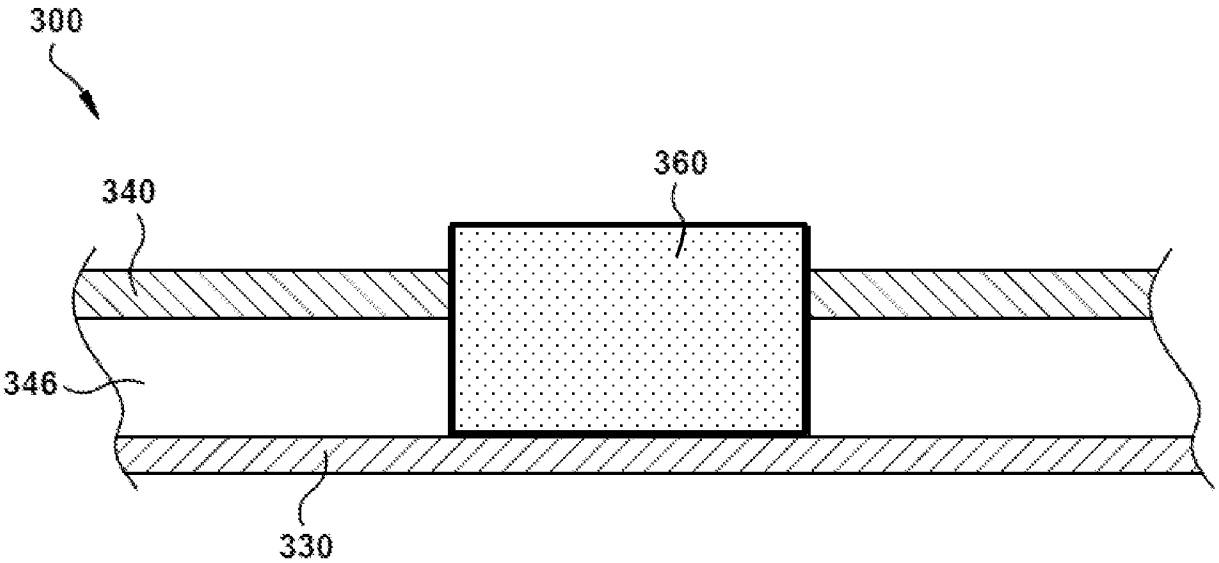
FIG. 8 shows a plan view of a cross-section of the wear pad system according to another embodiment of the invention employed at line A-A of FIG. 2.
Figure 9:
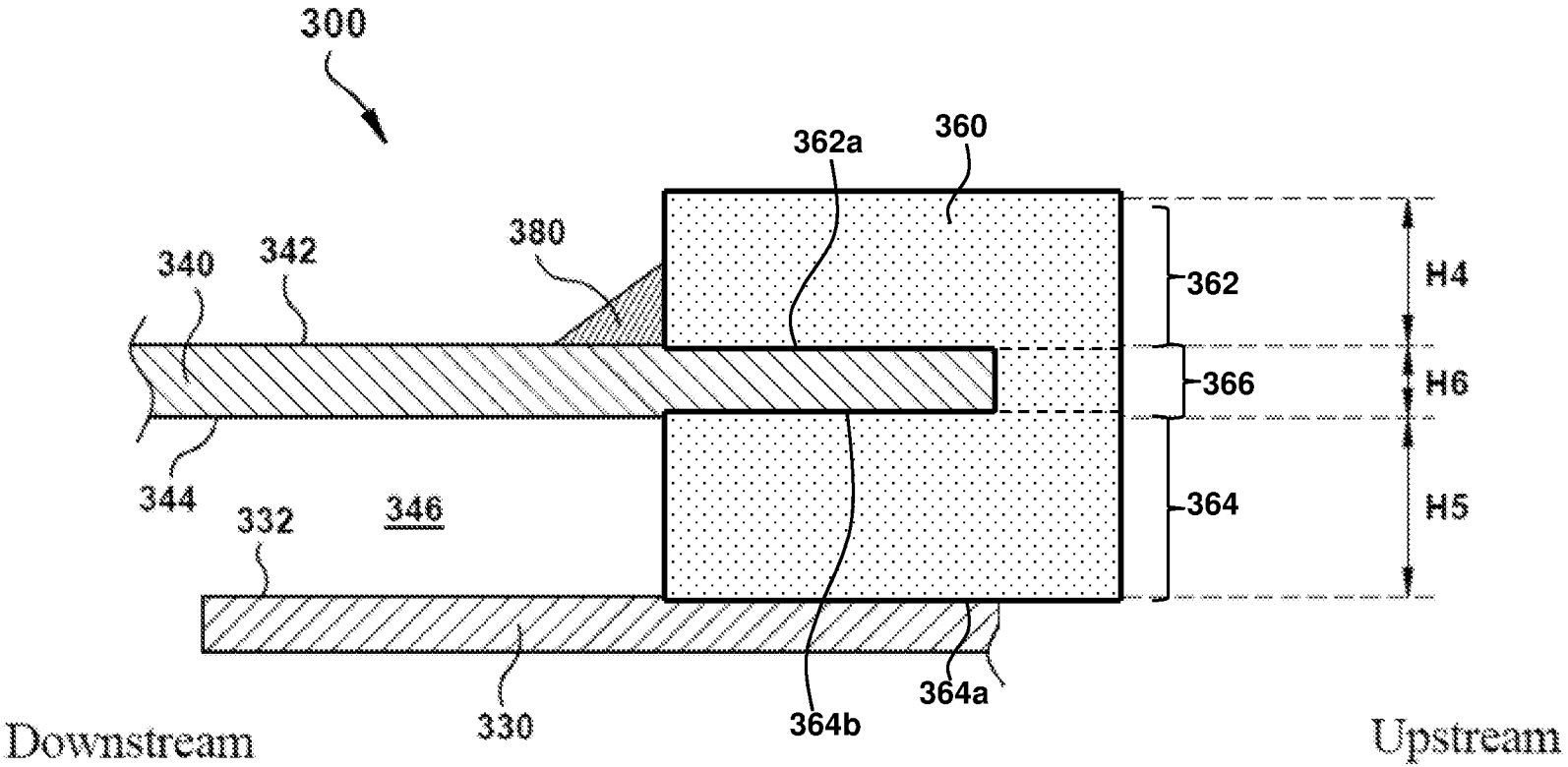
FIG. 9 shows a side view of the embodiment shown in FIG. 8.

FIGS. 8-9 show another embodiment of wear pad system 300 similar to the embodiment of wear pad system 200 that is shown in FIGS. 5-7. Wear pad system 300 of FIGS. 8-9 show wear pad 360 being "U-shaped" such that wear pad 360 substantially surrounds an upstream end of impingement sleeve 340. In this embodiment, in an operative state, wear pad 360 may include a radially outer portion 362, a radially inner portion 364, and a bight portion 366 therebetween. Radially outer portion 362 may include a radially inner surface 362*a* which is in contact with a radially outer surface 342 of impingement sleeve 340. Radially outer portion 362 may have a height H4 that is substantially equal to approximately 0.200 cm to approximately 0.500 cm. Radially inner portion 364 may include a radially inner surface 364*a* in contact with a radially outer surface 332 of TP forward ring 330. Radially inner portion 364 may also include a radially outer surface 364*b* in contact with a radially inner surface 344 of impingement sleeve 340. That is, radially inner portion 364 may be positioned substantially between impingement sleeve 340 and TP forward ring 330.

Radially inner portion 364 may have a height H5 that is substantially equal to the height of gap 346. In some embodiments, height H5 of radially inner portion 364 may be substantially equal to approximately 0.500 cm to approximately 0.700 cm. Bight portion 366 of wear pad 360 may be disposed substantially between radially outer portion 362 and radially inner portion 364 of wear pad 360 such that it contacts an upstream end of impingement sleeve 240. Bight portion 366 may have a height H6 of substantially equal to a height of impingement sleeve 240. In some embodiments, height H6 of bight portion may be substantially equal to approximately 0.100 cm to 0.200 cm. While not shown in FIGS. 8-9, it is to be understood that wear pad 360 may include the removable adhesive layers as described with respect to FIGS. 5-7.

Wear pad system 300 of this embodiment may also a weld 380 as described with respect to FIGS. 5-7. In this embodiment, weld 380 may secure wear pad 360 to impingement sleeve 340. Weld 380 may include, but is not limited to, carbon steel filler material, stainless steel, copper, aluminum, nickel, tungsten, zirconium and alloys thereof. Weld 280 may be provided at radially outer surface 342 of impingement sleeve 340 and a downstream surface of wear pad 360. In another embodiment, wear pad 360 may be brazed in to impingement sleeve 340. In yet another embodiment, wear pad 360 could be press-fitted between impingement sleeve 340 and TP forward ring 330.

In this embodiment, a retaining element (not shown in FIGS. 8-9) may also be employed similar to that as shown in FIG. 4. However, in this embodiment, retaining element may be installed such that retaining element surrounds impingement sleeve 340 and outer portion 364 of wear pad 360 and may place tension on impingement sleeve 340 such that the gap 346 is closed between radially inner surface 344 of impingement sleeve 340 and radially outer surface 332 of TP forward ring 330 by virtue of inner portion 364 of wear pad 360 therebetween.

Figure 10:
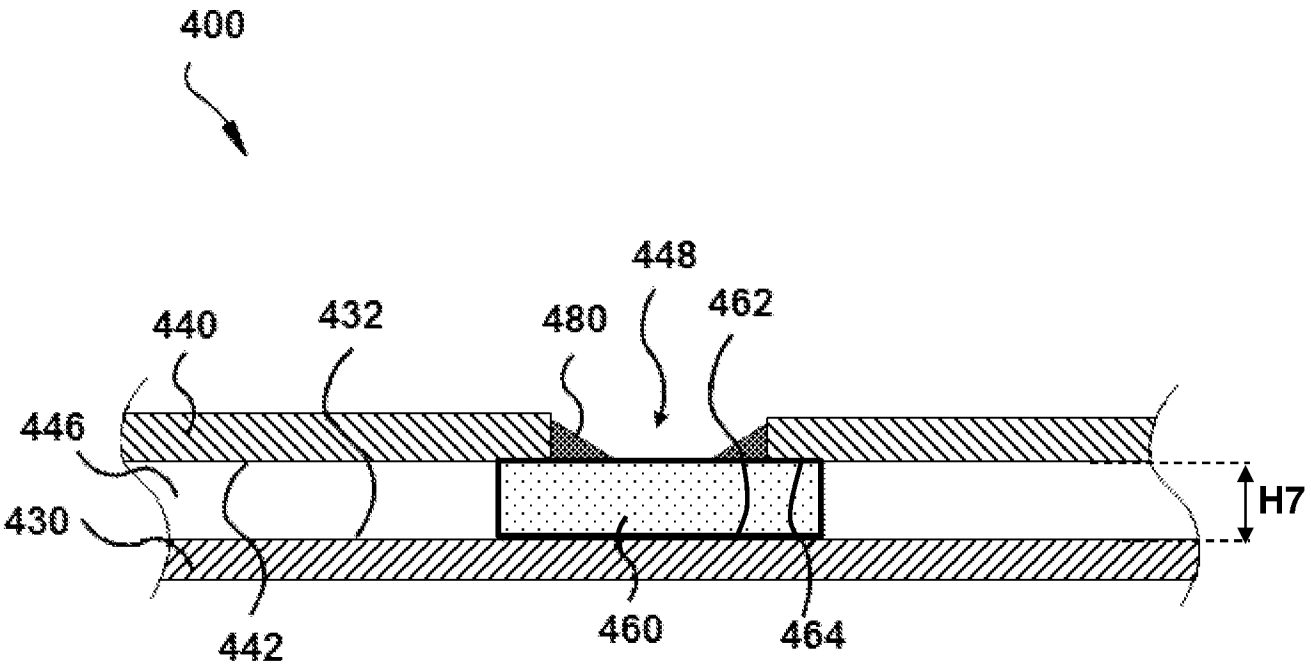
FIG. 10 shows a plan view of a cross-section of the wear pad system according to another embodiment of the invention employed at line A-A of FIG. 2.

FIG. 10 shows another embodiment of the invention. In this embodiment, wear pad 460 of wear pad system 400 may be substantially rectangular in shape. Wear pad 460 may be positioned between TP forward ring 430 and impingement sleeve 440 beneath a hole in the impingement sleeve 440. That is, a portion of radially outer surface 462 of wear pad 260 may be in contact with a radially inner surface 444 of impingement sleeve 440 and another portion of radially outer surface 462 may be exposed via the hole in impingement sleeve 440. A radially inner surface 464 of wear pad 460 may be in contact with a radially outer surface 432 of TP forward ring 430. Wear pad 460 may have a height H7 substantially equal to gap 446. In some embodiments, height H7 of wear pad 460 may be substantially equal to approximately 0.500 cm to approximately 0.800 cm.

In this embodiment, radially outer surface 462 of wear pad 460 may be joined to impingement sleeve 440 within hole. That is, wear pad system 400 may also include a weld 480. Weld 480 may be used to secure wear pad 460 to impingement sleeve 440. Weld 480 may include, but is not limited to a carbon steel filler material, stainless steel, copper, aluminum, nickel, tungsten, zirconium and alloys thereof. In another embodiment, wear pad 460 may be brazed to impingement sleeve 440. In yet another embodiment, wear pad 460 could be press-fitted between impingement sleeve 440 and TP forward ring 430.

In this embodiment, a retaining element (not shown in FIG. 10) may also be employed similar to that as shown in FIG. 4. However, in this embodiment, retaining element may be installed such that retaining element surrounds impingement sleeve 440 and may place tension on impingement sleeve 440 such that the gap 246 is closed between radially inner surface 444 of impingement sleeve 440 and radially outer surface 432 of TP forward ring 430 by virtue of wear pad 460 therebetween.

Referring back to FIGS. 3-4, aspects of the invention will now be described with respect to a method for coupling a wear pad into a turbine combustion system. As previously described, turbine combustion system may include a TP forward ring 130, an impingement sleeve 140 substantially surrounding TP forward ring 130 and a gap 146 therebetween. As known in the art, and previously discussed, impingement sleeves generally include two halves (shown by dotted lines in FIG. 4) which are welded together and maintained by at least one seal plate or buckle 110 (FIG. 4). Therefore, the method as described herein may include uninstalling or removing the at least one seal plate or buckle 110 from impingement sleeve 140. However, it is to be understood, that aspects of the method do not require disassembly of impingement sleeve 140, i.e. detachment of the two halves of impingement sleeve 140. Therefore, the method according to aspects of the invention allow for impingement sleeves to be manufactured in one circumferential piece rather than two arcuate halves.

The method may include installing wear pad 160 between impingement sleeve 140 and TP forward ring 130. In this embodiment, installing wear pad 160 may include drilling at least one hole 148 into impingement sleeve 140 to access gap 146. As used herein, drilling may refer to vertical drilling or horizontal drilling, for example, via a Quakenbush™ Drill, drill press or another drill as known in the art. In some embodiments, the method according to this embodiment may include drilling a plurality of holes 148 into impingement sleeve 140 such that the plurality of holes 148 are spaced circumferentially about the impingement sleeve 140.

Installing wear pad 160 may also include inserting wear pad 160 into the at least one hole 148 of impingement sleeve 140 through the gap 146 to contact the TP forward ring 130. Wear pad 160 may be inserted such that a radially inner portion 164 of wear pad 160 contacts a radially outer surface 132 of TP forward ring 130 and a radially outer portion 162 of wear pad 160 contacts a radially outer surface 142 of impingement sleeve 140. Where the method according to this embodiment includes drilling a plurality of circumferentially space holes 148, installing wear pad 160 may include inserting a wear pad 160 into each of the plurality of holes 148 in impingement sleeve 140 to contact TP forward ring 130.

Another step of the method may include tightening wear pad 160 via a tensioning tool. Tensioning tool may include, but is not limited to, a cable tensioning tool, a clamp or a clam-shell press. This aspect of the method ensures that radially inner portion 164 of wear pad 160 is in contact with radially outer surface 132 of TP forward ring 130 and that radially outer portion 162 of wear pad 160 is in contact with radially outer surface 142 of impingement sleeve 140. Where wear pad system 100 includes a plurality of wear pads 160, each wear pad 160 may be tightened via tensioning tool as described herein.

Another step of the method may include joining wear pad 160 to the impingement sleeve 140. As previously discussed, weld 180 may be used to secure wear pad 160 to impingement sleeve 140. Weld 180 may include, but is not limited to a carbon steel filler material, stainless steel, copper, aluminum, nickel, tungsten, zirconium and alloys thereof. As used herein, welding may refer to any welding processes as known in the art such as, but not limited to, arc welding, resistance welding, solid state welding, etc. In other embodiments, wear pad 160 may be joined to impingement sleeve 140 by brazing or press-fitting. Weld 180 may be provided at a radially outer circumference of radially outer portion 162 of wear pad 160 and a radially outer surface 142 of impingement sleeve 140. Where wear pad system 100 includes a plurality of wear pads 160, each wear pad 160 may be welded to impingement sleeve 140 as described herein.

Additionally, the method may include installing a retaining element 170 circumferentially about impingement sleeve 140 to place tension on impingement sleeve 140 and outer portion 162 of wear pad 160 such that gap 146 is closed between radially inner surface 144 of impingement sleeve 140 and radially outer surface 132 TP forward ring 130 at the location of wear pad 160. As described herein, installing retaining element 170 may include, but is not limited to, installing at least one of: a buckle, a clamp, a cable support, and a band, such as a belly band. Retaining element 170 may be installed such that is substantially surrounds impingement sleeve 140 and radially outer portion 162 of wear pad 160 thereon. Retaining element 170 may be used to ensure that radially inner portion 164 of wear pad 160 contacts radially outer surface 132 of TP forward ring 130 and radially outer portion 162 of wear pad 160 contacts radially outer surface 142 of impingement sleeve 140.

Further, the method according to this embodiment may include reinstalling at least one seal plate or buckle 110 to the impingement sleeve after installing retaining element 170. Retaining element ensures that gap 146 remains closed between impingement sleeve 140 and TP forward ring 130 at the location of the wear pad while the at least one seal plate or buckle is reinstalled. Once at least one seal plate or buckle 110 is reinstalled, retaining element 170 may be removed from impingement sleeve 140.

Referring back to FIGS. 5-7, aspects of the invention will now be described with respect to a method for coupling a wear pad into a turbine combustion system according to another aspect of the invention. As previously described, turbine combustion system may include a TP forward ring 230, an impingement sleeve 240 substantially surrounding TP forward ring 230, and a gap 246 therebetween. As known in the art, and previously discussed, impingement sleeves generally include two halves (shown by dotted lines in FIG. 7) which may be welded together and maintained by seal plates or buckles 210 (FIG. 7). Therefore, the method as described herein may include uninstalling or removing seal plates or buckles 210 from impingement sleeve 240.

The method may include installing a wear pad 260 in gap 246 between impingement sleeve 240 and TP forward ring 230. Wear pad 260 may be installed by inserting wear pad 260 from an upstream direction (FIG. 6) of impingement sleeve 240 and TP forward ring 230. Additionally, the at least one wear pad 260 may be inserted such that a radially outer portion 262 of wear pad 260 contacts a radially inner surface 244 of the impingement sleeve 240 and such that a radially inner portion 264 of wear pad 260 contacts a radially outer surface 232 of the TP forward ring 230.

As previously described, wear pad 260 of this embodiment may be a wear resistant wedge and include a plurality of removable adhesive layers 258. Where wear pad 260 includes a plurality of removable adhesive layers, embodiments of the method may also include adding or removing the removable adhesive layers 258 in order for wear pad 260 to be a desired dimension (length and height) prior to inserting wear pad 260 between impingement sleeve 240 and TP forward ring 230. That is, inserting wear pad 260 may include adjusting a dimension of the wear-resistant wedge by adding or removing at least one of the adhesive layers 258 of the wear-resistant wedge.

Another step of the method according to this embodiment may include tightening wear pad 260 to impingement sleeve 240 via a tensioning tool. Tensioning tool may include, but is not limited to, a cable tensioning tool, clamp, or a clam-shell press. This aspect of the method ensures that radially inner portion 264 of wear pad 160 is in contact with radially outer surface 232 of TP forward ring 230 and that radially outer portion 262 of wear pad 260 is in contact with radially inner surface 244 of impingement sleeve 240. Where wear pad system 200 includes a plurality of wear pads 260 (as shown in FIG. 7), each wear pad 260 may be tightened via tensioning tool as described herein. Further, another step of the method according to this embodiment may include joining wear pad 260 to impingement sleeve 240. As previously discussed, a weld 280 (FIG. 6) may be used to join wear pad 260 to impingement sleeve 240. Weld 280 may include, but is not limited to a carbon steel filler material, stainless steel, copper, aluminum, nickel, tungsten, zirconium and alloys thereof. Weld 280 may be provided at a radially outer surface 262 of wear pad 260 and a radially inner surface 144 (and/or an upstream surface 245) of impingement sleeve 240. Where wear pad system 200 includes a plurality of wear pads 260, each wear pad 260 may be welded to impingement sleeve 240 as described herein. In other embodiments, wear pad 260 may be joined to impingement sleeve 240 by brazing or press-fitting.

Additionally, the method according to this embodiment may also include installing a retaining element (not shown in FIGS. 5-7) circumferentially about impingement sleeve 240 to place tension on impingement sleeve 240 such that gap 246 is closed between impingement sleeve 240 and TP forward ring 230 at the location of wear pad 260. As described herein, retaining element may include, but is not limited to, a buckle, a clamp, a cable support, and a band, such as a belly band. Retaining element may be installed such that is substantially surrounds impingement sleeve 240. Retaining element may be used to ensure that radially inner surface 264 of wear pad 260 contacts radially outer surface 232 of TP forward ring 230 and radially outer surface 262 of wear pad 260 contacts radially inner surface 244 of impingement sleeve 240. Further, the method according to this embodiment may include reinstalling at least one seal plate or buckle 210 (FIG. 7) to the impingement sleeve 240 after installing retaining element. Retaining element ensures that gap 246 remains closed between impingement sleeve 240 and TP forward ring 230 at the location of the wear pad while at least one seal plate or buckle 210 is reinstalled. Once at least one seal plate or buckle 210 is reinstalled, retaining element may be removed from impingement sleeve 240.

Referring back to FIGS. 8-9, aspects of the method for coupling a wear pad into a turbine combustion system are substantially similar to the method described with respect to FIGS. 5-7 except for the installation of the wear pad. Installing wear pad 360 as shown in FIGS. 8-9 may include inserting wear pad 360 in gap 346 between impingement sleeve 340 and TP forward ring 330 from the upstream end of impingement sleeve 340 and TP forward ring 330. In this embodiment, wear pad 360 may be inserted such that radially inner surface **362*a* of radially outer portion 362 of wear pad 360 is in contact with radially outer surface 342 of impingement sleeve 340. Additionally, wear pad 360 may be inserted such that radially inner portion 364 of wear pad 360 is positioned substantially between impingement sleeve 340 and TP forward ring 330. That is, radially inner surface 364***a* of radially inner portion 364 may be in contact with radially outer surface 332 of TP forward ring 330 and radially outer surface 364*b* of radially inner portion 364 may be in contact with radially inner surface 344 of impingement sleeve 340. Further, wear pad 360 may be inserted from the upstream direction (at the upstream end) of impingement sleeve 340 and TP forward ring 330 until bight portion 366 of wear pad 360 contacts the upstream surface impingement sleeve 340.

Another step of the method according to this embodiment may include tightening wear pad 360 to impingement sleeve 340 via a tensioning tool. Tensioning tool may include, but is not limited to, a cable tensioning tool, clamp, or a clam-shell press. This step of the method ensures that gap 346 is closed between impingement sleeve 340 and TP forward ring 330. That is, this step tightens wear pad 360 into place such that outer surface 364*b* of inner portion 364 of wear pad 360 is in contact with inner surface 344 of impingement sleeve 340 and inner surface 364*a* of inner portion 364 of wear pad 360 is in contact with outer surface 332 of TP forward ring 330.

Another step of the method may include joining wear pad 360 to impingement sleeve 340. Wear pad 360 may be joined to impingement sleeve via a weld 380. Weld 380 may secure wear pad 360 to impingement sleeve 340. Weld 380 may include, but is not limited to, carbon steel filler material, stainless steel, copper, aluminum, nickel, tungsten, zirconium and alloys thereof. Weld 280 may be provided at radially outer surface 342 of impingement sleeve 340 and a downstream surface of wear pad 360. In other embodiments, wear pad 360 may be joined to impingement sleeve 340 by brazing or press-fitting.

Additionally, the method according to this embodiment may also include installing a retaining element (not shown in FIGS. 8-9) circumferentially about impingement sleeve 340 to place tension on impingement sleeve 340 and outer portion 362 of wear pad 360 such that gap 346 is closed between impingement sleeve 340 and TP forward ring 330 at the location of wear pad 360. As described herein, installing retaining element may include, but is not limited to, installing at least one of: a buckle, a clamp, a cable support, and a band, such as a belly band. Retaining element may be installed such that is substantially surrounds impingement sleeve 340 and outer portion 362 of wear pad 360. Retaining element may be used to ensure that radially inner surface 364*a* of inner portion 364 of wear pad 360 contacts radially outer surface 332 of TP forward ring 330 and radially outer surface 364*a* of inner portion 364 of wear pad 360 contacts radially inner surface 344 of impingement sleeve 340. Further, the method according to this embodiment may include reinstalling the at least one seal plate or buckle (not shown in FIGS. 8-9) to the impingement sleeve 340 after installing retaining element. Retaining element ensures that gap 346 remains closed between impingement sleeve 340 and TP forward ring 330 at the location of the wear pad while the at least one seal plate or buckle is reinstalled. Once the at least one seal plate or buckle is reinstalled, retaining element may be removed from impingement sleeve 340.

Referring back to FIG. 10, yet another embodiment of a method for coupling a wear pad into a turbine combustion system is provided for. Steps of this method are substantially similar to the steps which were described with respect to FIGS. 3-4. However, the method of this embodiment differs from the embodiment described with respect to FIGS. 3-4 in the installation of the wear pad and the joining of wear pad to the impingement sleeve. For example, this method may include uninstalling or removing of at least one seal plate or buckle as previously described. However, installation of wear pad 460 according to steps of this method may include drilling at least one hole 448 in impingement sleeve 440 to access gap 446. As used herein, drilling may refer to vertical drilling or horizontal drilling, for example, via a Quakenbush™ Drill, drill press or another drill as known in the art. In some embodiments, a plurality of holes 448 may be drilled into impingement sleeve 440 such that the plurality of holes 448 are spaced circumferentially about the impingement sleeve 440.

Installing wear pad 460 may also include inserting wear pad 460 from an upstream direction of impingement sleeve 440 and TP forward ring 430 such that a portion of a radially outer surface 464 of wear pad 460 is exposed by the at least one hole 448. That is, wear pad 460 may be positioned between TP forward ring 430 and impingement sleeve 440 beneath hole 448 in the impingement sleeve 440. Another portion of radially outer surface 462 of wear pad 460 may be in contact with a radially inner surface 444 of impingement sleeve 440. A radially inner surface 464 of wear pad 460 may be in contact with a radially outer surface 432 of TP forward ring 430. Where the method according to this embodiment includes drilling a plurality of circumferentially spaced holes 448 about impingement sleeve 440, a wear pad 460 may be inserted from an upstream direction of impingement sleeve 440 and TP forward ring 430 beneath each hole 448 in impingement sleeve 440.

This embodiment may also include tightening wear pad 460 to impingement sleeve 440 via a tensioning tool. Tensioning tool may include, but is not limited to, a cable tensioning tool, clamp, or a clam-shell press. This step of the method ensures that gap 446 is closed between impingement sleeve 440 and TP forward ring 430. That is, this step tightens wear pad 460 into place such that outer surface 464 of wear pad 460 is in contact with inner surface 444 of impingement sleeve 440 and inner surface 464 of wear pad 460 is in contact with outer surface 432 of TP forward ring 430.

Further, in this embodiment, wear pad 460 may be joined to impingement sleeve 440. Joining wear pad 460 to impingement sleeve 440 may include joining radially outer surface of wear pad 460 to impingement sleeve 440 within at least one hole 448. In some embodiments, wear pad 460 may be joined via a weld 480. Weld 480 may include, but is not limited to a carbon steel filler material, stainless steel, copper, aluminum, nickel, tungsten, zirconium and alloys thereof. Where wear pad system 400 includes a plurality of wear pads 460, each wear pad 460 may be welded to impingement sleeve 440 as described herein. In other embodiments, wear pad 460 may be joined to impingement sleeve 440 by brazing or press-fitting.

Additionally, as previously described, include installing a retaining element (not shown in FIG. 10) circumferentially about impingement sleeve 440 to place tension on impingement sleeve 440 such that gap 446 is closed between impingement sleeve 440 and TP forward ring 430 at the location of wear pad 460. As described herein, retaining element may include, but is not limited to, a buckle, a clamp, a cable support, and a band, such as a belly band. Retaining element may be installed such that is substantially surrounds impingement sleeve 440. Retaining element may be used to ensure that radially inner surface 464 of wear pad 460 contacts radially outer surface 432 of TP forward ring 430 and a portion of radially outer surface 462 of wear pad 460 contacts radially inner surface 444 of impingement sleeve 440. Further, the method according to this embodiment may include reinstalling the at least one seal plate or buckle (not shown in FIG. 10) to the impingement sleeve 440 after installing retaining element as previously discussed. Retaining element ensures that gap 446 remains closed between impingement sleeve 440 and TP forward ring 430 at the location of the wear pad while the at least one seal plate or buckle is reinstalled. Once the at least one seal plate or buckle is reinstalled, retaining element may be removed from impingement sleeve 440.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, substantially materials, acts, and equivalents of all means or step plus function elements in the claims below are intended to include any structure, substantially material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

We claim:

1. A wear pad system for a turbine combustion system including a transition piece (TP) forward ring, an impingement sleeve substantially surrounding the TP forward ring, and a gap between the TP forward ring and the impingement sleeve, the wear pad system comprising:

a wear pad extending through a hole in the impingement sleeve and through the gap to contact the TP forward ring, the wear pad formed as a unitary body having a radially outer portion and a radially inner portion, the radially outer portion in contact with a radially outer surface of the impingement sleeve and the radially inner portion in contact with a radially outer surface of the TP forward ring;

a weld formed directly on and between the wear pad and the impingement sleeve, the weld securing and affixing the wear pad to the impingement sleeve; and a retaining element surrounding the impingement sleeve, wherein the retaining element contacts and covers the radially outer portion of the wear pad.

2. The wear pad system of claim 1, wherein the radially outer portion has a diameter that is greater than a diameter of the radially inner portion.

3. The wear pad system of claim 2, wherein a height of the radially inner portion is substantially between 0.500 centimeters and 0.800 centimeters.

4. The wear pad system of claim 1, wherein the wear pad includes a wear-resistant pin.

5. The wear pad system of claim 1, wherein the retaining element includes at least one of: a buckle, a clamp, a cable support, and a band.

6. The wear pad system of claim 1, further comprising:

a plurality of wear pads; and a plurality of holes spaced circumferentially about the impingement sleeve, wherein each wear pad extends through a respective hole in the plurality of holes and through the gap to contact the TP forward ring.

7. A wear pad system for a turbine combustion system including a transition piece (TP) forward ring, an impingement sleeve substantially surrounding the TP forward ring, and a gap between the TP forward ring and the impingement sleeve, the wear pad system comprising:

a wear pad formed as a unitary body having a first surface and a second surface, at least a portion of the wear pad positioned within the gap such that the first surface of the wear pad contacts the impingement sleeve and the second surface of the wear pad contacts a radially outer surface of the TP forward ring;

a weld formed directly on and between the wear pad and the impingement sleeve, the weld securing and affixing the wear pad to the impingement sleeve; and a retaining element positioned circumferentially about the impingement sleeve, wherein the retaining element contacts and covers a radially outer portion of the wear pad, and places tension on the impingement sleeve such that the gap between the TP forward ring and the impingement sleeve is closed.

8. The wear pad system of claim 1, wherein the wear pad is formed from a wear-resistant material.

9. The wear pad system of claim 8, wherein the wear pad includes a nickel-based alloy.

10. The wear pad of system of claim 1, wherein the weld is formed on the radially outer surface of the impingement sleeve.

11. The wear pad system of claim 5, wherein the retaining element contacts the radially outer portion of the wear pad.

12. The wear pad system of claim 1, wherein the radially outer portion of the wear pad includes a first surface that contacts the radially outer surface of the impingement sleeve.

13. The wear pad system of claim 12, wherein the radially inner portion of the wear pad includes a second surface that contacts the radially outer portion of the TP forward ring.

14. The wear pad system of claim 7, wherein the first surface of the wear pad contacts a radially outer surface of the impingement sleeve.

15. The wear pad system of claim 14, wherein the weld is formed on the radially outer surface of the impingement sleeve.

16. The wear pad system of claim 7, wherein the wear pad further comprises:

a radially inner portion in contact with the TP forward ring, wherein the radially outer portion contacts the impingement sleeve.

17. The wear pad system of claim 16, wherein the first surface of the wear pad is formed on the radially outer portion.

18. The wear pad system of claim 16, wherein the second surface of the wear pad is formed on the radially inner portion.

* * * * *